US005694756A

United States Patent [19]

Lindner

[11] Patent Number: 5,694,756

[45] Date of Patent: Dec. 9, 1997

[54] PROCESS AND DEVICE TO STOP AN OPEN-END ROTOR SPINNING DEVICE

[75] Inventor: Gallus Lindner, Ingolstadt, Germany

[73] Assignee: Reiter Ingolstadt Spinnereimaschinenbau AG, Ingolstadt, Germany

[21] Appl. No.: 768,342

[22] Filed: Dec. 17, 1996

Related U.S. Application Data

[63] Continuation of Ser. No. 435,717, May 5, 1995, abandoned.

[30] Foreign Application Priority Data

May 26, 1994 [DE] Germany ..... 44 18 358.5

[51] Int. Cl.[6] ..... D01H 13/26

[52] U.S. Cl. ..... 57/263; 57/83; 57/86; 57/269; 57/278; 57/302; 57/304

[58] Field of Search ..... 57/263, 269, 278, 57/302, 304, 83, 86

[56] References Cited

U.S. PATENT DOCUMENTS

| | | | |
|---|---|---|---|
| 3,698,174 | 10/1972 | Boucek et al. . | |
| 3,728,853 | 4/1973 | Schiltknecht | 57/83 X |
| 3,999,362 | 12/1976 | Schultz et al. | 57/263 |
| 4,020,622 | 5/1977 | Lattion . | |
| 4,384,451 | 5/1983 | Elias et al. | 57/263 |
| 4,541,233 | 9/1985 | Raasch et al. | 57/263 |
| 4,676,059 | 6/1987 | Artzt et al. | 57/263 |
| 4,744,209 | 5/1988 | Wassenhoven | 57/263 X |
| 4,787,198 | 11/1988 | Stahlecker | 57/263 X |
| 4,998,404 | 3/1991 | Ferro et al. | 57/263 |
| 5,095,689 | 3/1992 | Ferro et al. | 57/263 |
| 5,191,760 | 3/1993 | Ball et al. | 57/263 |
| 5,456,073 | 10/1995 | Theirron et al. | 57/263 |

FOREIGN PATENT DOCUMENTS

| | | |
|---|---|---|
| 1084662 | 9/1967 | United Kingdom . |
| 1408223 | 10/1975 | United Kingdom . |

*Primary Examiner*—William Stryjewski
*Attorney, Agent, or Firm*—Dority & Manning, PA

[57] ABSTRACT

When an open-end rotor spinning device is stopped, a short yarn end is produced. For this, and in synchronization with the interruption of fiber feeding to the opener device (116), the fibers which continue to be combed out of the leading end of the fiber sliver (2), as well as the fibers still present in the clothing of the opener device (116), are prevented from continuing to accumulate on the fiber collection surface (136) of the spinning rotor (13). To carry out this process, the device (115) for the stoppage of the fiber feeding device (110) is connected to a control device (3) by means of which a device (134, 135, 172, 173) for the shortening of the yarn end can be switched on temporarily as the spinning device (11) is stopped.

15 Claims, 4 Drawing Sheets

PROCESS AND DEVICE TO STOP AN OPEN-END ROTOR SPINNING DEVICE

This is a continuation of application Ser. No. 08/435,717, filed May 5, 1995, which was abandoned upon the filing hereof.

BACKGROUND OF THE INVENTION

The instant invention relates to a process to stop an open-end rotor spinning device in which a fiber sliver is conveyed during the normal spinning process to an opener device which combs fibers out of the leading end of the fiber sliver. The fibers are conveyed to the fiber collection surface of a spinning rotor where they are incorporated into the end of a continuously withdrawn yarn, whereby a yarn end is produced as the spinning device is stopped by interruption of fiber feed to the opener device. The invention relates as well to a device to carry out this process.

When an open-end rotor spinning device is stopped, the spinning process is interrupted in that the fiber feed to the opener device is terminated (DD-PS 63.306). At that point in time, fibers still remain in the clothing of the opener roller. In addition the continuously rotating opener roller continues to comb additional fibers out of the sliver. All these fibers are fed to the spinning rotor where they are incorporated into the end of the yarn which is still in the process of being withdrawn. Since the quantity of the fibers combed out of the leading end of the fiber sliver gradually decreases, the yarn end which is phasing out becomes increasingly thin but quite long. Such a long yarn end is difficult to find later on the bobbin for piecing. In addition, the danger exists that the thin phasing out yarn end may break and that the broken yarn end may be deposited in an uncontrolled manner on the machine and become caught in its rotating parts.

OBJECTS AND SUMMARY OF THE INVENTION

It is therefore a principal object of the instant invention to create a process and a device by means of which a thin phasing out yarn end may be easily avoided when a spinning device is stopped. Additional objects and advantages of the invention will be set forth in part in the following description, or may be obvious from the description, or may be learned through practice of the invention.

The objects are attained according to the invention in that a short yarn end is produced when the spinning device is stopped. If the yarn end is (relatively) short, it no longer has an opportunity to phase out in a thin condition but is so strong that breakage and the disadvantages resulting therefrom are avoided.

A "short yarn end" in the sense of the instant invention shall be understood to be the yarn segment which is produced after switching off the fiber feed device. The word "short" relates here to the known stopping process according to which the fiber tuft of the stopped fiber sliver continues to be combed out and the combed-out fibers are incorporated into the yarn which at first still continues to be drawn off.

The production of a short phasing out yarn end may be effected in different manners. In a preferred variant of the process according to the invention, the fibers which continue to be combed out of the leading end of the fiber sliver, as well as those which are still in the clothing of the opener roller, are prevented from continuing to collect on the fiber collection surface of the spinning element in synchronization with the interruption of fiber feed to the opener roller in order to produce a short yarn end. Thus, they cannot be incorporated into the end of the yarn in the process of being drawn off, so that the fibers still combed out of the fiber sliver which gradually decrease in quantity may not lead to a prolongation of the yarn end. Instead, the yarn end in the process of being drawn off can no longer incorporate the growing fiber ring, so that the length of the yarn end, as of the moment when the depositing of fibers on the fiber collection surface is terminated, is merely as long as the circumference of the fiber collection groove of the spinning rotor, i.e. only a few centimeters, depending on the current rotor diameter. The yarn, although it tapers, is so short that it does not lead to the formerly prevailing disadvantages either as it is drawn off from the spinning rotor, nor as it is wound up on the bobbin, nor during the search on the bobbin in course of a subsequent piecing process.

In principle the fiber deposit on the fiber collection surface may be minimal or may also occur after the interruption of fiber feed to the opener equipment, but it has proven to be especially advantageous for the fiber deposit on the fiber collection surface to be terminated simultaneously with the interruption of fiber feed to the opener roller.

The depositing of fibers on the fiber collection surface may be controlled in different manners. Preferably, the feeding of air to the spinning rotor is stopped for this purpose along the fiber conveying path leading to the fiber collection surface. For this purpose, an over-pressure is advantageously produced in the spinning rotor.

Alternatively, or in addition, the effect of the negative pressure applied at the fiber collection surface is interrupted in order to terminate air feed along the fiber conveying path going to the fiber collection surface if a negative pressure is applied during the normal spinning process at the fiber collection surface by means of an outside source of negative pressure.

In another advantageous variant of the process according to the invention, depositing of fiber is prevented in that the fibers still being conveyed from the opener equipment are evacuated, with a suction air stream taking effect at the fiber conveying path of the fiber collection surface for that purpose. This suction air stream may be brought to bear at any desired location between fiber feeding device and fiber collection surface, but according to a preferred variant of the process according to the invention, it is brought to bear near the circumference of the opener equipment.

The yarn end leaves the spinning rotor after incorporation of the fibers on the fiber collection surface. In order to avoid that fibers which may continue to be combed out of the fiber sliver may settle in the opener equipment because the are prevented from reaching the fiber collection surface, it is advantageous for the suction air stream to be brought to bear until the opener equipment no longer combs out any fibers from the leading end of the fiber sliver. In this manner, all the fibers combed out of the fiber sliver are evacuated from the opener equipment by the suction air stream.

To produce the suction air stream, a service unit capable of travelling along a plurality of identical spinning devices is advantageously brought into active connection with the spinning station to be serviced to produce the suction air stream.

Even if a short phasing out yarn end is especially advantageous because it already has a form that is well suited for spinning, it may be useful, instead of preventing the fibers from being deposited on the fiber collection surface to obtain in this manner a shortened, tapered yarn end, for the yarn end to be shortened during the stopping process by cutting and for the severed yarn segment to be fed back into the spinning rotor from which it is removed by a stream of suction air.

To carry out the process according to the invention, provisions are made according to the instant invention for the device for the stopping of the fiber feeding device to be connected to a control system by means of which a device for the shortening of the yarn end may be switched on briefly when the spinning device is stopped.

To be able to set the length of the yarn end, provisions may be made in an advantageous embodiment of the invention for the control system to be assigned a timing device by means of which the moment of switching on the device for the shortening of the yarn end may be set relative to the moment at which the fiber feed device is stopped.

If a controlled suction channel is provided between the fiber feeding device and the fiber collection surface which can be made to act on the fiber conveying path, the controlled suction channel is advantageously made as part of the device to shorten the yarn end. This suction channel may be brought into action in principle at any desired location along the fiber conveying path. Preferably, the suction channel is provided with a suction air opening located in the circumferential wall of a housing surrounding the opener roller. Here it is advantageous for the suction channel to be capable of being connected to a service unit which travels along a plurality of identical spinning devices.

According to an alternative advantageous embodiment of the invention, the device for the shortening of the yarn end is made in the form of a device for the reduction of the negative pressure in the spinning rotor. In this case the negative pressure in the spinning rotor can be reduced by different means. Thus, with a housing containing the spinning rotor to which a suction channel with a control valve is connected, the device for the reduction of the negative pressure in the spinning rotor is constituted by this control valve in the suction channel. When this control valve is closed, the negative pressure no longer takes effect, so that no suction air stream which may be able to convey the fibers is produced in the direction of the spinning rotor.

A sudden interruption of fiber deposit on the fiber collection surface may be achieved in an alternative embodiment of the instant invention in that the device for the reduction of the negative pressure in the spinning rotor is provided with a controlled over-pressure channel which can be brought to bear in the spinning rotor.

The over-pressure channel may end, for example, in a housing containing the spinning rotor and may take effect from there in the interior of the rotor. It is however also possible to provide for the over-pressure channel to be installed in the opening rotor cover of the housing.

In another advantageous embodiment of the invention, the device for the reduction of the negative pressure in the spinning rotor is made in the form of a device for the temporary opening of the rotor cover. By opening the rotor cover, the previously active negative pressure in the spinning rotor collapses so that no more suction air flows through the fiber feeding channel to the fiber collection surface or is fed over the open rotor rim to the continuously active source of negative pressure for the production of negative spinning pressure.

In another advantageous embodiment of the device according to the invention, the device for the shortening of the yarn end is made in the form of a yarn severing device. This yarn severing device is preferably placed in the yarn draw-off pipe which guides the yarn being drawn off from the spinning rotor.

The process and the device according to the instant invention make it possible to shorten the yarn end in a simpler manner than with the yarn ends produced by means of previously customary processes and devices. Depending on the design and/or settings of the device, the yarn end may have a short conical shape or even a rectangular shape. In any case, the result is that long yarn ends with only a few fibers in their cross-section are avoided. The yarn end wound up on the bobbin is not pressed in as tightly in this manner as could be the case previously, and is therefore easy to find again by the suction nozzle of a piecing device,so that the piecing success is increased. Dirt in the machine or the formation of laps on the rotating shafts due to torn yarn ends is effectively avoided by the instant invention, as the yarn ends are of such strength that the danger of yarn breakage in this area is practically non-existent. The device according to the invention is simple in construction and can as a rule be retrofitted on machines which are already in operation, without difficulties and at low cost.

Examples of embodiments of the invention are explained in further detail below with the help of drawings.

DETAILED DESCRIPTION OF THE PREFERRED EMBODIMENT

Figure 1:
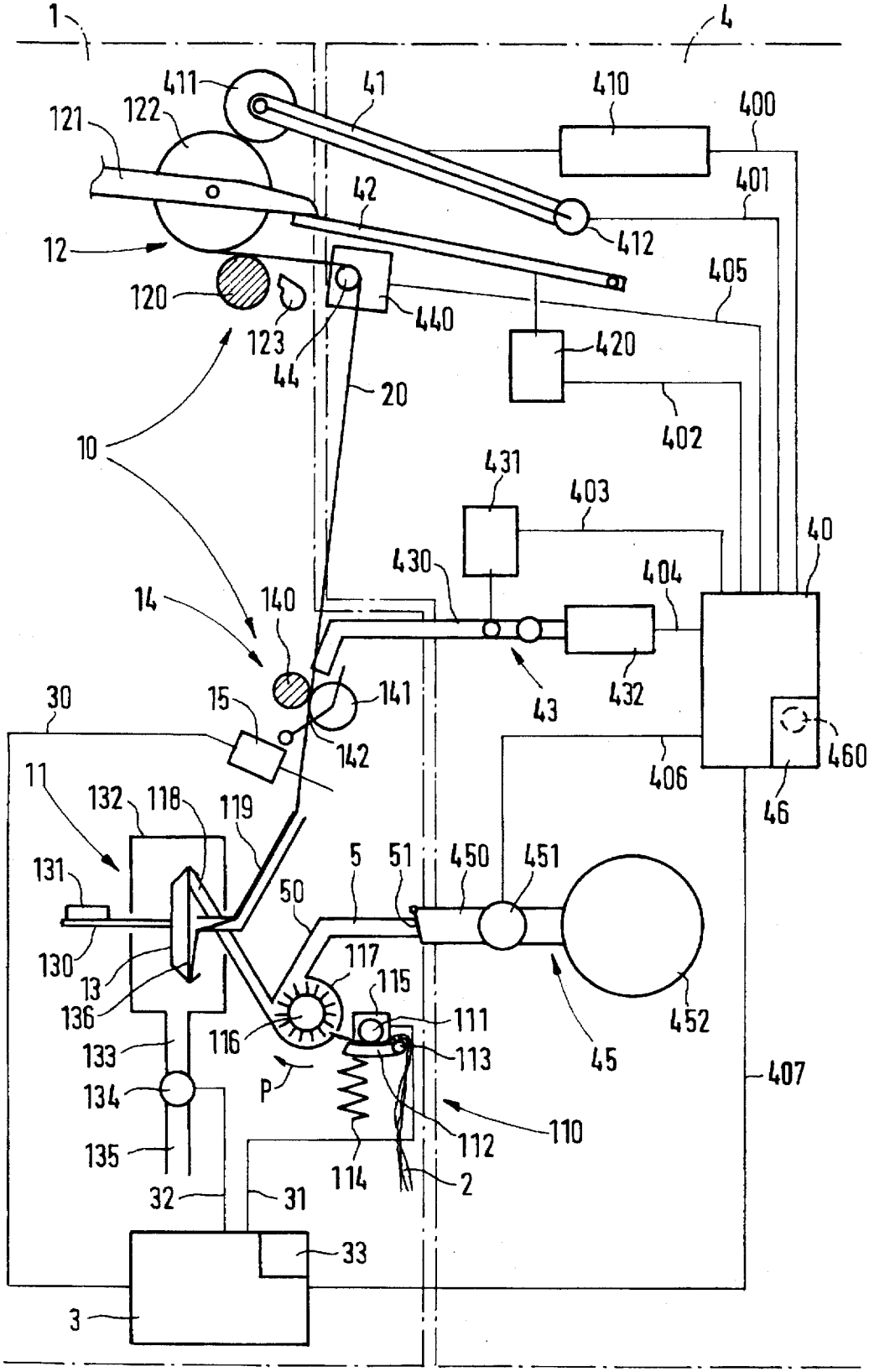
FIG. 1 shows an open-end spinning device made according to the invention in a cross-section.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment may be used on another embodiment to yield a still further embodiment.

The open-end rotor spinning device shown in FIG. 1 is drawn only schematically, and those elements which are not necessary in order to understand the invention have been omitted. This figure shows in its left half and in schematic representation a spinning station 10 of an open-end spinning machine 1. This spinning station 10 is equipped with an open-end spinning device 11, as well as with a winding device 12.

Each open-end spinning device 11 has a fiber feeding device 110 to feed a fiber sliver 2 to a opener device 116. The fiber feeding device 110 in the embodiment shown consists of a delivery roller 111 as well as of a feed trough 112 which interacts elastically with it. The feed trough 112 is mounted on an axle 113 so as to be capable of swivelling and is pressed elastically against the delivery roller 111 by means of a spring 114. The delivery roller 111 is driven via a controlled coupling 115 by a central drive which is not shown.

The opener device 116 in the embodiment shown in FIG. 1 is essentially designed as an opener roller installed in a housing 117. From it, a fiber feeding channel 118 extends to a spinning rotor 13. The latter is driven or braked in the usual manner. In the embodiment shown, the spinning rotor 13 is equipped with a shaft 130 against which a tangential belt 131 is brought to bear and from which it can be lifted off. The shown spinning rotor 13 is located in a housing 132 which is provided with a suction opening 133 connected via a controlled valve 134 and a suction channel 135 to a source of negative pressure which is not shown.

A yarn draw-off pipe 119 is provided to guide the yarn 20 to be drawn off from the fiber collection surface 136 of the spinning rotor 13.

Withdrawal is effected by means of a pair of draw-off rollers 14, with one driven draw-off roller 140 and one draw-off roller 141 in elastic contact with the former and driven by it. For this purpose the draw-off roller 141 is mounted on a swivel arm 142.

On its way between the open-end spinning device 11 and the pair of draw-off rollers 14, the yarn 20 is monitored by a yarn monitor 15.

The yarn 20 is wound up in the winding device 12 which is provided for that purpose with a driven winding roller 120. The winding device 12 is furthermore equipped with a pair of swivelling winding arms 121 which hold a bobbin 122 rotatably between them. The bobbin 122 lies on the winding roller 120 during the undisturbed spinning process and is therefore driven by it. The yarn 20 to be wound up on bobbin 122 is inserted into a traversing yarn guide 123 which is moved back and forth along the bobbin 122 and thereby ensures even distribution of the yarn 20 over bobbin 122.

The yarn monitor 15, the coupling 115 as well as the valve 134, are connected for control via channels 30, 31 and 32 to a computer unit or control device 3 containing a timing device 33.

A service unit 4 which is also equipped with a control device 40 connected for control via a channel 407 to the computer unit or control device 3 of the open-end spinning machine 1 for the control of the piecing process is able to travel alongside the open-end spinning machine. The control device 40 is furthermore connected via a channel 400 to the swivel drive of a swivel arm 41 which supports an auxiliary drive roller 411 at its free end. The auxiliary drive roller 411 is driven by a drive motor 412 which is also connected via a channel 401 to the control device 40 for control purposes.

The winding arms 121 of the winding device 12 can be assigned swivel arms 42 which are pivotably mounted on the service unit 4 and whose swivel drive 420 is connected via a channel 402 to the control device 40 for control purposes.

A lift-off device 43 can be presented to the draw-off roller 141 of the pair of draw-off rollers 14. This lift-off device is provided with a swivel arm 430 which is able to cooperate with the swivel arm 142 of the draw-off roller 141. For this purpose the swivel arm 430 is connected to a swivel drive 431 and to a lifting drive 432 which are in turn connected via channels 403 or 404 for control to the control device 40.

The service unit 4 is furthermore equipped with a yarn cast-off device 44 with a drive 440 controlled via a channel 405 by the control device 40.

The outlet 50 of a suction channel 5 lets out into the housing 117 of the opener device 116 in the open-end spinning machine 1, as seen in the direction of fiber flow (arrow P) after the outlet of the fiber feeding channel 118, its end away from the opener device 116 being closed by a flap 51. A suction channel 450 of a suction device 45 of the service unit 4 can be presented to the suction channel 5 of the open-end spinning device 11. This suction channel 450 is connected via a valve 451 to a source of negative pressure 452. The valve 451 in turn is connected via a channel 406 to the control device 40 for control purposes.

During normal spinning operation, the fiber sliver 2 is fed by means of the fiber feeding device 110 to the opener device 116 which separates the fiber sliver 2 into fibers which are conveyed to the fiber collection surface 136 of the spinning rotor 13 and are deposited there. The end of yarn 20, in the process of being drawn off, is connected to this accumulation of fibers which forms a fiber ring in spinning rotor 13 and incorporates the fibers into its end as a result of the rotation imparted by the spinning rotor 13 while the yarn 20 is being withdrawn from the open-end spinning device 11 by the draw-off device 14. The bobbin 122 lies in a known manner on the winding roller 120 during the spinning process and thereby winds up the yarn 20, whereby the traversing yarn guide 123 distributes the yarn in a traversing manner over the bobbin 122.

During the normal spinning process no negative pressure is applied to the end of suction channel 450 away from the opener device 116, so that the flap 51 is held in its closed position due to its own weight. The suction effect of the negative spinning pressure applied via suction opening 133 takes effect through the fiber feeding channel 118 all the way to the opener device 116.

If a spinning station 10 is to be stopped, a yarn breakage is produced by actuating the coupling 115 of the fiber feeding device 110, said yarn breakage being them signalled by the yarn monitor 15 of the control device 3. The actuation of the coupling 115 causes the delivery roller 111 to be stopped and the feeding of more fiber sliver 2 to the opener device 116 to be stopped. In addition, valve 134 is closed so that no more negative pressure is applied at the housing 132 containing the spinning rotor 13. Because of the lacking suction effect, the fibers which continue to be combed out from the leading end of the stopped fiber sliver 2 are prevented from entering the fiber feeding channel 118, so that the fibers are not deposited on the fiber collection surface 136 of the spinning rotor 13 and consequently cannot be incorporated into the end of the yarn 20 which, for the time being, continues to be drawn off. The yarn end therefore merely incorporates those fibers which have entered the spinning rotor up to the moment when the negative spinning pressure previously acting via channel 133 was shut off. From this moment on, only the length of the rotor circumference can therefore be incorporated.

In synchronization with the stopping of fiber feed, the bobbin 122 is lifted in the usual manner from the winding roller 120. This may be done by means of a separating plate which is pushed between the winding roller 120 and the bobbin 122. Due to the short length of the yarn end and the fact that it does not merely consist of a few fibers, the end of yarn 20 remains on the surface of the bobbin and is not pressed into it.

The opener device 116 continues to run uninterruptedly during that time.

After a certain time, the service unit 4 reaches this spinning station 10 where the yarn 20 has broken. In such a case the service unit 4 can be called to this spinning station by a known call-up device. The service unit 4 can however also patrol along a defined number of spinning stations 10 and reach also the stopped spinning station 10 in this manner. When the service unit 4 has reached the spinning station 10 concerned, its control device 40 interrogates the control device 3 via channel 407 and is informed in this manner on whether servicing is required or not at the spinning station 10 concerned. The control device 3 is designed so that it always transmits only such information to the service unit 4 which concerns the spinning station 10 at which the service unit 4 is located at the moment.

When the service unit 4 reaches a spinning station 10 requiring service, said service unit 4 comes to a stop. The winding arms 121 are supported in the manner already described by the bobbin lifting device on the machine by means of the swivel arms 42 as described earlier, whereupon the element which has held the bobbin 122 separated from the winding roller 120 until then is able to return into its rest position. The auxiliary drive roller 411 is now presented to the bobbin 122. The suction channel 5 on the machine is furthermore presented the suction channel 450 of the service unit 4. Furthermore the draw-off roller 141 is lifted off the driven draw-off roller 140 by means of the lift-off device 43. In addition the yarn 20 is located in the usual manner on the surface of the bobbin. Since the yarn end is short and thick as a result of the described manner in which the spinning station 10 has been stopped, it is easily found and taken up, whereupon it is drawn off from the bobbin 122 which is lifted off from the winding roller 120 and is fed back into the yarn draw-off pipe 119. In this process, the yarn is laid down over the yarn cast-off device 44 and is held there.

Now, at the latest, the valve 134 is opened again so that the spinning rotor 14 may be cleaned in the known manner. The fibers and dirt particles loosened from the spinning rotor 13 are evacuated through the suction channel 135 by means of the negative spinning pressure which again takes effect in housing 132. Under the action of the negative spinning pressure, those fibers which were prevented from being deposited on the fiber collection surface 136 as the spinning station 10 was stopped now also reach the spinning rotor 13 and enter the suction channel 135.

Following the cleaning of the spinning rotor 13, the valve 134 is closed to the negative spinning pressure and the valve 451 is opened for the suction channel 450. The negative pressure prevailing in the suction channel 450 causes the flap 51 at the end of suction channel 5 to be opened by being lifted from its seat.

Furthermore, the spinning rotor 13 which had been stopped until then is released again and runs up to its operating speed or merely to a predetermined piecing speed. In this case, the piecing program can be designed so that piecing is carried out either at a constant speed of the spinning rotor 13 or in course of its run-up curve.

The fiber feeding device 110 is then switched back on by actuation of the coupling 115. This causes the fiber sliver 2 to be fed again to the opener device 116. Fibers produced are sucked away again by the active source of negative pressure 452 from housing 117. After a period of time which can be set, the valves 134 and 451 are actuated so that no more negative pressure prevails in the suction channel 5 and so that negative spinning pressure prevails instead again in housing 132 via suction channel 135. The fibers entering the housing 117 of the opener device 116 are thus sucked via fiber feeding channel 118 to the spinning rotor 13 where they are deposited in the known manner on the fiber collection surface 136. In synchronization with this, by being cast off by the yarn cast-off device 44, the yarn 20 is fed back to the fiber collection surface 136 where the fibers are incorporated into the fed-back yarn end. The drawing off of the yarn is switched on by the control device 3 via control device 40 of the service unit 4 and is accelerated in accordance with the curve set by the control device 3. Control is here effected by means of the bobbin 122 driven by the auxiliary drive roller 411. When full draw-off speed has been reached, the swivel arm 142 of the draw-off roller 141 is released by the swivel arm 430, whereupon the draw-off roller 141 which is not shown and is actuated in the known manner comes to bear against the driven draw-off roller 140, so that further withdrawal by the pair of draw-off rollers 14 takes place and the roller 122 merely winds up the yarn 20 which it is being fed. It is however also possible to control the yarn withdrawal curve by means of the draw-off roller 141 in that the contact pressure of the draw-off roller 141 is controlled by means of the lift-off device 43.

As described above, a short, or short phasing out yarn end is produced as the open-end spinning device 11 is stopped by preventing the fibers which continue to be combed out of the leading end of the stopped fiber sliver 2 by the continued running of the opener roller from continuing to collect on the fiber collection surface 136 of the spinning rotor 13. The termination of fiber deposit on the fiber collection surface 136 is synchronized with the stopping of the fiber feeding device 110 as a rule in such manner that as the coupling 115 is actuated, the valve 134 is closed simultaneously and thereby fiber deposit on the fiber collection surface 136 is stopped. In this case, the timing device 33 can be omitted. If however the valve 134 is alternatively actuated already shortly before actuation of the coupling 115, the time is set by means of the timing device 33 which is then necessary. Such timing control is especially advantageous if the service unit 4 is already at the concerned spinning station 10 and if its suction channel 450 is already in connection position at suction channel 5 of the open-end spinning machine 1 at the moment when the spinning station 10 is being stopped. The spinning station 10 is then stopped in the following manner.

The undisturbed spinning process which may have to be interrupted, for example because the desired bobbin size has been reached, is ended once the service unit 4 has reached the spinning station 10 in question through issuance of an appropriate command by the control device 3 to the control device 40. In order to prevent the fibers from still being conveyed to the fiber collection surface 136 of the spinning rotor 13, not only the negative spinning pressure is interrupted by closing the valve 134 in this example, but at the same time negative pressure is applied to the outlet 50 of the suction channel 5 by opening the valve 451 in the suction channel 450 of the service unit 4. In synchronization with this, possibly with delay relative to the switching over of the negative pressure prevailing in the opener device, the coupling 115 is now actuated to stop the fiber feeding device 110. The fibers which are still in the opener device after switching over the negative pressure or which still enter the opener device 116 due to the continuous combing of the leading fiber sliver end, are now sucked through suction channel 5 and 450 to the source of negative pressure 452. It goes without saying that a fiber receiving device in the form of a filter or similar device is provided at an appropriate location.

By switching over the negative pressure and thereby by deflecting the fiber stream, no more fibers enter the spinning rotor 13, so that fiber feed into the spinning rotor 13 is terminated very suddenly. The yarn end has thereby a defined length and is extremely short as it phases out. Its length is determined by the circumference of the spinning rotor 13.

If an entire spinning machine is to be stopped, this may be done in two different manners. According to the process first described above, the depositing of fibers on the fiber collection surface 136 of the spinning rotor 13 is stopped by merely stopping the negative spinning pressure by closing the valve 134 and by thus preventing the effect of the negative pressure which was applied until then to the fiber collection surface 136. This process prevents depositing of fibers on the fiber collection surface 136 of a spinning rotor 13. This is especially effective if the distance between the fiber feeding device 110 and the inlet into the fiber feeding channel 118 is relatively small, so that the fibers are not yet imparted the speed required to loosen them from the clothing of the opener roller as said opener roller rotates and thus continue to remain in the clothing.

By means of the process just described, i.e. sudden switching off of the negative spinning pressure at the open-end spinning device 11 in question, it is possible to stop all the spinning stations of a spinning machine 1 at the same time.

Since this switching-off process can be carried out autonomously by the service unit 4 without any human intervention, it is possible to provide alternatively for all the spinning stations 10 to be switched off one after the other by the service unit 4 traveling along the machine. In that case not only the valve 134 would be closed to switch off the negative spinning pressure, but at the same time the negative pressure of the service unit 4 is applied to the suction channel 5, whereby the flap valve 51 which had been closed during the spinning process because of the negative pressure prevailing in the opener device 116 opens automatically.

Figure 5:
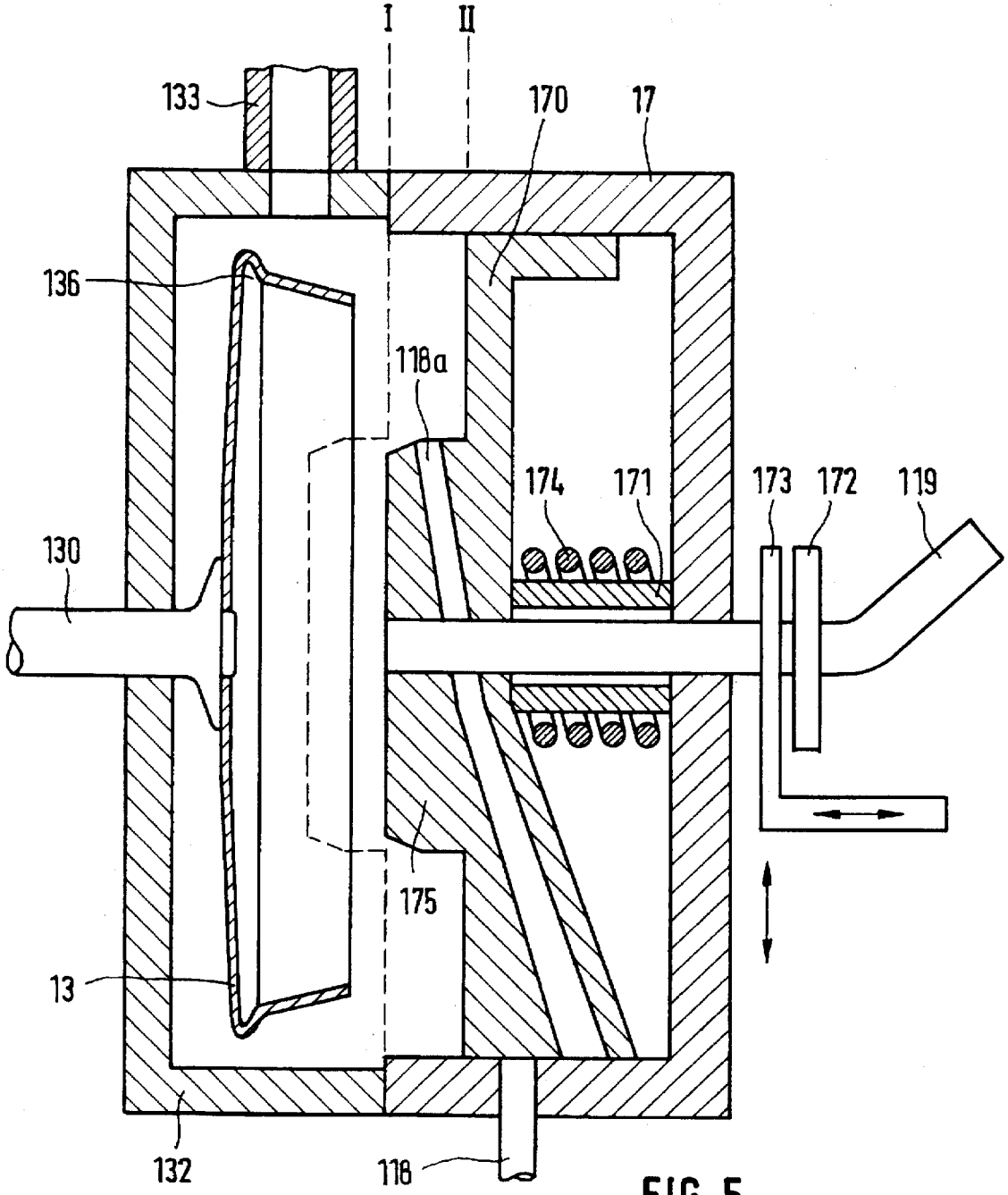
FIG. 5 shows another embodiment of the open-end spinning device in a cross-section.

A variant of the device by means of which depositing of fibers on the fiber collection surface 136 is prevented by interrupting the conveying of air through the fiber feeding channel 118 to the spinning rotor 13 shall be explained below with the help of FIG. 5.

As this drawing shows, the housing 132 is covered by a cover 17 which accepts a displaceable rotor cover 170. This rotor cover 170 can assume a first position I, its operating position during normal spinning, as well as a second position II during the stopping process as the position of the cover 17 relative to same is changed. A sleeve 171 is provided as a guide of the rotor cover 170 in the cover 17, with the yarn draw-off pipe 119 being held in said guide and being in turn rigidly connected to the rotor cover 170, whereby a stop ring 172 with which a fork 173 is able to interact is located on its end outside the cover.

The fork 173 is mounted on the service unit 4 and can be moved in horizontal as well as in vertical direction in such a manner that it can reach the shown stop position in which it interacts with the stop ring 172 as well as be moved again out of this stop position.

A compression spring 174 bears on the one hand upon the inner wall of cover 17 and on the other hand on the radial surface of the rotor cover 170 towards the forward face of the cover 17. This rotor cover 170 is provided with an extension 175 in which a section **118*a* of the fiber feeding channel 118** is located.

In its operating position, the rotor cover 170 assumes position I shown with hatch-marks in which the segment **118*a* constitutes the prolongation of the fiber feeding channel 118. If the feeding of fiber-bearing air along the fiber conveying path going to the fiber collection surface 136 is to be interrupted in order to terminate fiber feeding to the fiber collection surface 136, the rotor cover 170 is brought into position II in which segment 118*a* is no longer the prolongation of the other part of the fiber feeding channel 118 by means of the fork 173 which is meshing with the stop ring 172. The fibers which are still in the channel segment 188*a* can thus be evacuated through the suction opening 133 without being incorporated into the yarn end while the yarn end incorporates the fibers which are still on the fiber collection surface 136 of spinning rotor 13**.

The sudden interruption of fiber feeding to the fiber collection surface 136 produces a short phasing-out yarn end which is very well suited for subsequent piecing, even without any additional preparation.

Upon completion of the stopping process, the fork 173 releases the stop ring 172 again so that the rotor cover 170 returns into its position I under the action of the compression spring 174.

It is also possible to provide a rotor cover 16 (see FIG. 2) which can be lifted off from the housing 132 so that the fiber feeding channel 118 with its outlet end is lifted in part or entirely out of the spinning rotor 13, so that fibers which are still being fed by the opener device 116 even after the fiber feeding device 110 has been switched off may go over the open edge of the spinning rotor 13 into suction opening 133 to be thus evacuated. This too results in a short phasing out yarn end, just as the procedure described earlier.

The device to end the conveying of fiber to the collection surface 136 is in both cases a device for temporary opening of the rotor cover 16 or 170, whereby at one time air is admitted from the atmosphere surrounding the device while being stopped at another time.

In another alternative embodiment of the process (not shown) and independently of whether the gap between the open rotor edge and the rotor cover 16 or 170 is enlarged or not, the air stream conveyed to the suction opening 133 is intensified. For this purpose it is possible to provide for the valve 134 to be made in the form of a switch-over valve connecting in one position housing 132 to a suction channel 135, in which the negative pressure needed for spinning is made available, and in the other position connects it to another channel (not shown) which makes available increased negative pressure. When housing 132 is connected to this suction channel with greater negative pressure as the spinning station 10 is stopped, a more intensive air stream is also produced in the fiber feeding channel 118 or in the channel segment **118*a* thereof, so that the fibers coming out of the fiber feeding channel 118 or out of its channel segment 118*a* follow this suction air stream better and are thus prevented from being deposited on the fiber collection surface 136 of the spinning rotor 13**.

In the last-mentioned example of an embodiment of the invention, a fiber deposit is thus prevented by intensifying the air flow. It goes without saying that the negative pressure can also be switched off completely when necessary by a suitable design of the switch-over valve or by providing an additional shut-off valve in the suction channel.

According to the process described above, the movement of air in the direction of the spinning rotor 13 through the fiber feeding channel 118 is prevented in order to prevent fibers from being deposited on the fiber collection surface 136 of the spinning rotor 13 in that the negative pressure applied before to the housing 132 of the spinning rotor 13 is switched off by closing valve 134 or by shutting the fiber feeding channel 18. The same effect can also be achieved by producing overpressure in the spinning rotor. Such a device is shown in FIG. 2.

Figure 2:
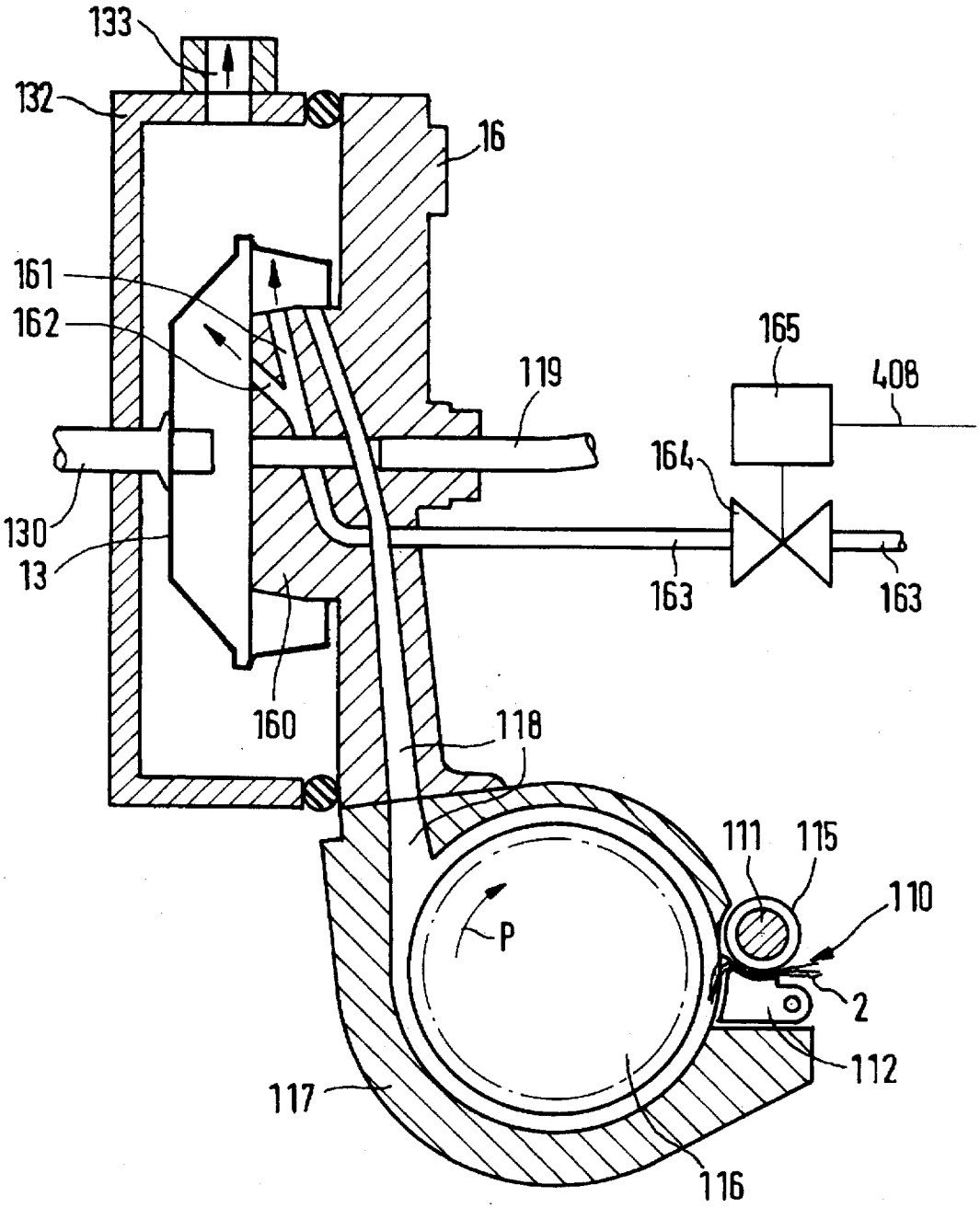
FIG. 2 shows a modified embodiment of the open-end spinning device according to the invention, in a cross-section.

As shown in FIG. 2, the housing 132 is covered by a rotor cover 16 which is provided with a cover extension 10 in which the outlet opening of the fiber feeding channel 118 and the inlet opening of the yarn draw-off pipe 119 are located extending into the interior of the spinning rotor 13. In addition, the cover extension 160 contains two blowing channels 161 and 162 which are directed against the fiber collection surface 136 of the spinning rotor 13 and are suitable for the cleaning of the spinning rotor 13. These blowing channels 161 and 162 are fed through a common compressed-air channel 163. The compressed-air channel 163 contains a valve 164 whose drive 165 is connected by means of a circuit 408 to the control device 3 (see FIG. 1).

If fiber feed along the fiber conveying path leading to the fiber collection surface 136 is to be interrupted, overpressure is produced by opening the valve 164 in the spinning rotor 14. The negative spinning pressure must not be actuated simultaneously in that case, so that the fibers which are now fed into the spinning rotor 13 are taken over the open edge of said spinning rotor 13 into housing 132 and from there are conveyed through the suction opening 133 to the negative-pressure source (not shown).

The described process and also the explained device may be varied in many ways, e.g. by replacing individual characteristics by equivalents or through some other combination of the described or equivalent characteristics. Thus, for example, a yarn severing device which can be brought into action on the yarn end may be provided in order to obtain an especially short yarn end during the stopping process of the spinning device.

Figure 3:
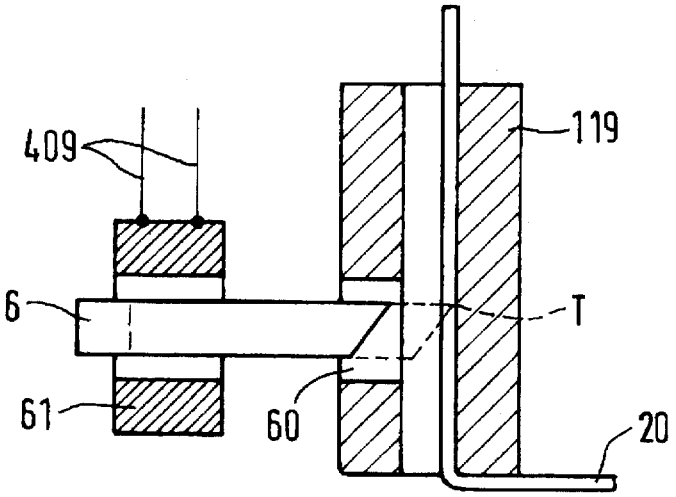
FIG. 3 shows a yarn cutting device located in the yarn draw-off pipe, in a section.

In the embodiment according to FIG. 3, a knife 6 is provided which enters through a slit in the yarn draw-off pipe 119 into said yarn draw-off pipe 119, i.e. which is located in the yarn draw-off pipe 119. In synchronization with the actuation of the fiber feeding device 110 and while the yarn 20 is still in the process of being drawn off, the knife 6 is pressed mechanically, electro-magnetically, pneumatically, hydraulically, or otherwise against the facing wall of the yarn draw-off pipe 119. Yarn 20 is thus severed at this point T. According to FIG. 3, a coil 61 is provided, whereby the knife 6 is made in form of an armature of same. The coil is connected via circuit 409 to the control device 3.

When the yarn is severed at severing point T as the spinning device is stopped, the yarn shown in FIG. 3 above this severing point T continues to be drawn off and to be wound up on bobbin 122 while the end of yarn 20 shown in FIG. 3 below this severing point 3 is fed back into the spinning rotor 13 by the negative pressure prevailing in the spinning rotor 13 and is subsequently, during cleaning of the spinning rotor 13, removed from the rotor in the usual manner by means of a suction air stream.

Figure 4:
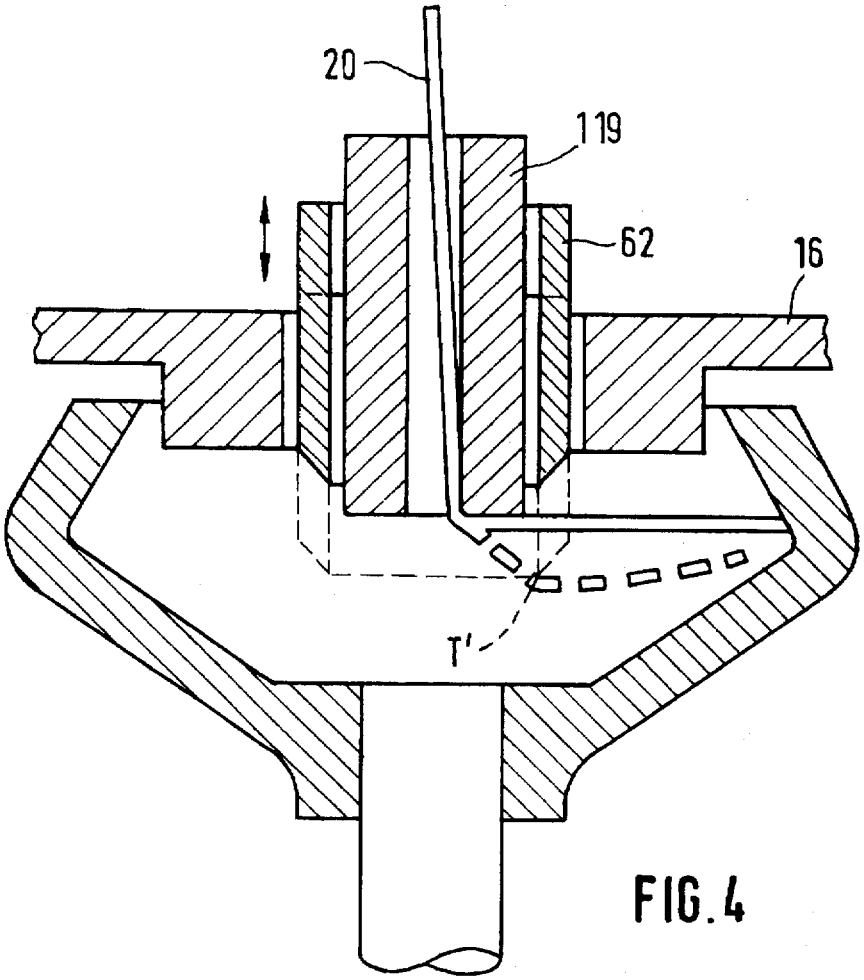
FIG. 4 shows a yarn cutting device which can be moved into the spinning rotor.

FIG. 4 shows a modified embodiment of a severing device. The yarn draw-off pipe 119 is here surrounded by a center ring punch 62 which can be displaced along the yarn draw-off pipe 119. This center ring punch 62 can be made in the form of an armature of a coil which is not shown here, for example.

During spinning, the center ring punch 62 is in the shown upper position, so that it does not touch the yarn in the process of being drawn off. To sever the yarn 20 during the stopping process the center ring punch 62 is brought by suitable means (e.g. a coil) into the lower position shown by hatch marks, with the yarn end still rotating in the spinning rotor 13 being severed at point T'. The severed yarn end remains in the spinning rotor 13 and is sucked off in the usual manner during a cleaning process and is thus evacuated, while the shortened yarn end is wound up on bobbin 122.

In the cases described through FIGS. 3 and 4 a yarn end which is very short and no longer tapers is produced during the stoppage process of spinning station 10.

In the cases according to FIGS. 3 and 4 the yarn end is wound up on the bobbin after being shortened, just as in the process according to FIGS. 1 and 2, so that it may not hang around in an uncontrolled manner at the spinning station and possibly wind itself around moving parts.

The closer the device for the obtention of a short phasing-out or abruptly ending yarn end is placed to the yarn forming point, i.e. spinning rotor 13, the more possible it is to precisely determine the length of the yarn end. It has been shown that it is not sufficient to merely remove the leading fiber sliver end from the influence range of the opener device 116. Aside from the fact that this is a corrective action which cannot be used at the same time for other purposes, the fibers which are already present in the clothing of the opener roller are not prevented from still entering the spinning rotor 13 where they are incorporated into the end of the yarn 20 in the process of being drawn off. It is therefore important to take at least additional measures when a reversible fiber feeding device 110 or one which can be moved away from the opener device 116 is provided, in order to prevent feeding of these fibers which are still in the opener device 116 to the fiber collection surface 136 of the spinning rotor 13, and this can be done in one or the other of the described manners.

As mentioned earlier, the described process, and also the explained device, can be varied in many different ways. Thus it is not necessary, for example, to provide a separate negative-pressure source 451 on the service unit 4, but the suction channel 450 of the service unit 4 can also be connected in a known manner to a negative-pressure source on the machine with which the suction channel 135 is also connected.

Different designs are also possible for the fiber feeding device 110, and instead of a coupling 115 for the delivery roller 111, it may be provided with a lift-off device to lift the feed trough 112 off the uncontrolled delivery roller.

It is furthermore possible to drive the drive roller 140 from a drive shaft via a controlled induction coupling (not shown) and to control the yarn withdrawal in accordance with the existing slip.

In the above-described embodiment (see FIG. 1), the fibers which continue to be conveyed by the opener device 116 are evacuated in that a suction air stream is put into effect at an outlet 50 in the circumferential area of the opener device. In principle, it is however immaterial at which point along the fiber conveying path this suction air stream is brought into action, e.g. also in the fiber feeding channel 118, but care must be taken that the suction air opening required for this is placed in the fiber conveying path in such a manner that it does not impede the conveying of fibers during the normal spinning process.

In principle the time during which the suction air stream is brought into action in the fiber conveying path also does not play a significant role since the forward fiber sliver end, i.e. the so-called fiber tuft, has reached a state after a relatively short time following the stopping of the fiber feeding device 110 in which only few fibers are combed out. Nevertheless it is advantageous, in order to avoid the incorporation of even these few fibers into the yarn end in the process of being drawn off, if the switching off of the suction air stream is delayed until no more fibers are combed out.

The above description shows that the suction air stream is produced along the fiber conveying path by means of a service unit 4 which travels along the spinning machine with its plurality of identical spinning stations 10. It goes without saying that with an appropriate connection to the suction channel on the machine, the service unit 4, if one is provided, need not assume this task. Such a direct connection to a suction channel on the machine makes it possible to evacuate the fibers also in case of a so-called mass stoppage, i.e. when an entire group of spinning stations 10 or all the spinning stations 10 of a spinning machine are stopped.

As was described above, the control device 3 which controls the coupling 115 for the stopping and resumed driving of the fiber feeding device 110 is also connected to the device which serves for the shortening of the yarn end, independently of how this device for the reduction of yarn end length is designed. Such a device for the reduction of the length of the yarn end is understood according to the above description to be a device which either prevents the deposit of fibers on the fiber collection surface 136 as of a given point in time, so that the incorporation of the fiber ring which is still present on the fiber collection surface 136 may produce a short phasing-out yarn end which is especially well suited for subsequent piecing, or a yarn severing device (knife 6 or center ring punch 62). In the fist instance the device for the shortening of the yarn end may be constituted at least in part by the controlled suction channel (suction channel 135) for the production of negative spinning pressure or by a suction channel in the yarn conveying path. Such suction channels can also be used in combination and may not only be capable of being switched on and off, but their intensity would also be controllable.

If an overpressure channel is provided to prevent the deposit of fibers on the fiber collection surface 136, it is not necessary for it to be installed in the rotor cover 16 according to FIG. 2, but it is absolutely also possible to let it end in the housing 132, e.g. if the suction opening 133 can be selectively subjected to overpressure.

It should be apparent to those skilled in the art that various modifications and variations can be made in the present invention without departing from the scope and spirit of the invention. For example, features illustrated or described as part of one embodiment can be used on another embodiment to yield a still further embodiment. Thus, it is intended that the present invention cover such modifications and variations as come within the scope of the appended claims and their equivalents.

I claim:

1. A process for producing a short yarn end for piecing in an open-end spinning device of a spinning machine wherein, during normal spinning operations, a fiber sliver is fed to an opener device which combs fibers from the leading end of the fiber sliver, the combed out fibers conveyed along a fiber conveying path to a fiber collection surface of a spinning rotor for incorporation into an end of a continuously withdrawn yarn, said process comprising stopping the feeding of the fiber sliver to the opener device and in synchronization therewith interrupting the flow of fibers from the opener device to the end of the continuously withdrawn yarn in the fiber collection surface so that fibers which continue to be combed out of the end of the stopped fiber sliver which is still in contact with the opener device are substantially simultaneously prevented from being incorporated into the end of the withdrawn yarn, the withdrawn yarn having a resulting yarn end having a defined relatively short length which does not incorporate thinned out fibers from the stopped fiber sliver, said interrupting the flow of fibers comprising bringing a suction airstream into action along the fiber conveying path substantially simultaneously with said stopping of feeding of the fiber sliver to the opener device to evacuate fibers conveyed from the opener device.

2. The process as in claim 1, further comprising bringing the suction airstream into action in the circumferential area of the opener device.

3. The process as in claim 1 further comprising maintaining the suction airstream in action until the opener roller no longer combs fibers out of the end of the stopped fiber sliver.

4. The process as in claim 1, further comprising generating the suction airstream with a travelling service unit summoned to a spinning station of the spinning machine.

5. The process as in claim 1, wherein said interrupting the flow of fibers comprises displacing a rotor cover away from the spinning rotor substantially simultaneously with said stopping of feeding of the fiber sliver to the opener device so as to divert any fibers conveyed along the fiber conveying path away from the fiber collection surface.

6. The process as in claim 1, wherein said interrupting the flow of fibers comprises blowing compressed air in an area of the spinning rotor to generate an overpressure in the area substantially simultaneously with said stopping of feeding of the fiber silver to the opener device so as to divert any fibers conveyed along the fiber conveying path away from the fiber collection surface.

7. The process as in claim 1, wherein said interrupting the flow of fibers comprises severing the continuously withdrawn yarn at a location along a yarn withdrawal path operatively downstream of the spinning rotor substantially simultaneously with said stopping of feeding of the fiber sliver to the opener device so that any fibers conveyed along the fiber conveying path are prevented from being incorporated into the end of the withdrawn yarn in the spinning rotor.

8. A system for producing a short yarn end for piecing in an open-end spinning device of a spinning machine wherein said spinning machine has an opener device and a feed mechanism for feeding a fiber sliver to said opener device which combs fibers from the leading end of the fiber sliver, the combed out fibers conveyed along a fiber conveying path to a fiber collection surface of a spinning rotor for incorporation into an end of a yarn which is formed in said spinning rotor and continuously withdrawn from said spinning rotor, said system comprising a device for stopping said sliver feed mechanism, and a mechanism for interrupting feed of combed out fibers from said opener device to said end of said continuously withdrawn yarn, said system further comprising a control device configured with said sliver feed mechanism and said interrupting mechanism for stopping feed of said sliver to said opener device substantially simultaneously with interrupting feed of combed out fibers to said yarn end so that fibers combed out of said stopped silver are prevented from being incorporated into said yarn end.

9. The system as in claim 8, wherein said interrupting mechanism comprises a controllable suction channel disposed between said opener device and said fiber collection surface, said suction channel in pneumatic communication with a suction source and controlled by said control device.

10. The system as in claim 9, further comprising a housing generally surrounding said opener device, said suction channel in communication with said housing.

11. The system as in claim 9, wherein said suction source is carried by a travelling service unit, said suction channel mateable with said suction source once said travelling service unit is disposed adjacent said open-end spinning device.

12. The system as in claim 8, further comprising a rotor housing for said spinning rotor and a rotor housing cover, said interrupting mechanism comprising compressed air channels disposed through said rotor housing cover in communication with a source of compressed air, wherein upon directing compressed air into said rotor housing fibers combed out and conveyed from said stopped fiber silver are diverted from said fiber collection surface.

13. The system as in claim 8, further comprising a rotor housing for said spinning rotor and a rotor housing cover, said interrupting mechanism comprising a mechanism for at least partially moving said rotor housing cover away from said rotor housing, wherein upon moving said rotor housing cover away from said rotor housing fibers combed out and conveyed from said stopped fiber sliver are diverted from said fiber collection surface.

14. The system as in claim 8, wherein said interrupting mechanism comprises a cutting mechanism disposed to cut the continuously withdrawn yarn at a location along a yarn withdrawal path operatively downstream of said spinning rotor, said cutting mechanism in communication with and controlled by said control device for cutting the continuously withdrawn yarn substantially simultaneously with said stopping of feeding of the fiber silver to said opener device so that any fibers conveyed from said stopped fiber silver are prevented from being incorporated into the end of the withdrawn yarn in said spinning rotor.

15. The system as in claim 14, further comprising a yarn draw-off pipe disposed to convey the continuously withdrawn yarn away from said spinning rotor, said cutting device operably disposed in said draw-off pipe.

* * * * *